United States Patent [19]

Moulding, Jr. et al.

[11] Patent Number: 4,460,106

[45] Date of Patent: Jul. 17, 1984

[54] PILL DISPENSER

[76] Inventors: Thomas S. Moulding, Jr., 1954 Glencoe St., Denver, Colo. 80220; Donald G. Ellis, Geneva Park, Boulder, Colo. 80302

[21] Appl. No.: 317,430

[22] Filed: Nov. 2, 1981

[51] Int. Cl.[3] ..... B65G 59/06

[52] U.S. Cl. ..... 221/1; 221/4; 221/7; 221/21; 221/241; 221/265; 221/288

[58] Field of Search ..... 221/2, 4–5, 221/7–8, 21, 155, 241, 252, 263–265, 288, 304; 222/36, 38, 361–362, 370, 305, 288; 206/534, 540

[56] References Cited

U.S. PATENT DOCUMENTS

| | | | |
|---|---|---|---|
| 50,916 | 11/1865 | Davis | 222/288 |
| 3,215,310 | 11/1965 | Hurst et al. | 221/7 |
| 3,289,885 | 12/1966 | Villaveces | 221/288 |
| 3,297,198 | 1/1967 | Wright, Jr. | 221/5 |
| 3,347,425 | 10/1967 | Beushausen et al. | 221/241 X |
| 3,484,818 | 12/1969 | Ino | 221/288 |
| 3,601,250 | 8/1971 | Merila | 206/42 |
| 3,638,830 | 2/1972 | Belokin, Jr. | 221/246 |
| 3,730,387 | 5/1973 | McConnell et al. | 221/265 |
| 3,866,805 | 2/1975 | Hamilton, Jr. | 222/427 |
| 3,874,564 | 4/1975 | Huneke | 221/288 X |
| 3,889,847 | 6/1975 | Uroshevich et al. | 221/265 |
| 3,991,908 | 11/1976 | Thomas | 221/265 X |
| 4,003,500 | 1/1977 | Schornig | 222/288 X |
| 4,150,766 | 4/1979 | Westendorf et al. | 221/265 X |

*Primary Examiner*—Charles A. Marmor

[57] ABSTRACT

A pill dispenser mechanism is provided in which a multilayered compartment is releasably attachable to a receptacle for pills in such a way that pills may be selectively advanced into one compartment, then by selective advancement of one of the compartment layers transfer the pill from the first compartment into a discharge compartment to permit sequential recovery of pills therefrom. In order to accommodate different sized pills, the compartments may be provided with different sized openings to conform to the substantial size and configuration of the pill. Electrical contact switches may be associated with the compartments to sense for the purpose of recording the movement of a pill between one or more, or a combination of both, compartments.

38 Claims, 11 Drawing Figures

PILL DISPENSER

This invention relates to dispensing methods and apparatus; and more particularly relates to a novel and improved method and means for dispensing pills from a receptacle as well as recording the removal of each pill in a highly effective and dependable manner.

BACKGROUND AND FIELD OF THE INVENTION

Innumerable types of dispensing devices are commercially available for the purpose of selective removal of small objects, such as, pills or tablets from a storage receptacle. However, the dispensing of pills or tablets for medicinal purposes presents special problems in terms of effective removal or recovery of pills of different selected sizes and maintaining an accurate record of pills removed or recovered over extended periods of time. The problems associated with the dispensing of pills are especially acute in hospitals where a great number must be dispensed one or more times a day to a great number of patients, and the nurse or attendant must maintain and preserve an accurate record of the number and types of pills dispensed. In this relation it is highly desirable to provide a manner and means for dispensing of pills which is conformable for use in cooperation with data processing systems so that an accurate record may be automatically maintained and displayed as a part of the day-to-day activities of a hospital. This is of especial importance when one considers the constant changing of personnel on duty and the amount of time required for the dispensing and recording of pills to each patient. Moreover, the size and configuration of pills vary over wide extremes and it is therefore also desirable to provide a means of dispensing which is readily conformable for different sized pills and can be interchangeably used according to the size of pill to be dispensed without requiring a totally different construction of pill dispenser for each different size and shape of pill.

In the past, various approaches have been taken to the dispensing of pills and other small objects. Representative of such approaches are disclosed in U.S. Pat. No. 3,289,885 to Villaveces, Ino Pat. No. 3,484,818 and Merila Pat. No. 3,601,250. For instance, Villaveces discloses offset passages to permit selective removal of a pill while the patents both to Ino and Merila disclose other types of dispensing caps which will permit removal of a single pill or tablet. Another patent of interest is U.S. Pat. No. 3,638,830 to Belokin, Jr. In which relatively rotatable discs form a cap assembly for a bottle and will permit selective trapping of a pill in a channel so that by rotation of one disc relative to another the pill may be advanced from the channel through another discharge opening. U.S. Pat. to McConnell et al No. 3,730,387 discloses an approach in which the pill must be transferred from the receptacle into a dispensing cap and the cap removed from the receptacle in order to recover the pill. Other representative patents of interest are U.S. Pat. Nos. 3,866,805 to Hamilton, Jr. and 3,889,847 to Uroschevich et al. For instance, in Uroschevich et al the pill dispenser is capable of dispensing one tablet at a time via a series of movements in order to advance a pill through the dispenser so as to make it difficult for a child to accidentally remove pills from the receptacle. Nevertheless. Nevertheless, there is lacking an effective means for dispensing different configurations and sizes of medication, such as, flat, rounded or oblong pills, tablets or capsules and particularly in such a way as to assure delivery without danger of jamming; yet at the same time permit the user to visually follow the progress of the pill, tablet or capsule as it progressively advances from a receptacle through a dispenser cap for selected release from a discharge opening in the cap.

SUMMARY OF INVENTION

It is therefore an object of the present invention to provide for a novel and improved method and means for dispensing pills or tablets from a container which is tamper-proof and prevents jamming or damage to the pills or tablets in the process of removal.

It is another object of the present invention to provide for a novel and improved dispensing mechanism which is conformable for use in the dispensing of pills or tablets of different sizes in a safe dependable manner.

It is further object of the present invention to provide for a novel and improved dispensing apparatus which is capable of recording and/or displaying the number of pills recovered over a given time interval and wherein the recording and/or displaying means is automatically responsive to the advancement of the pills or tablets through the dispensing apparatus.

It is an additional object of the present invention to provide for a novel and improved dispensing mechanism which is adaptable for interchangeable use on different sizes and types of containers as well as for use in association with the dispensing of different sizes and shapes of pills or tablets which will facilitate dispensing of one or more pills at a time through a compact, easily actuated and assembled mechanism.

In accordance with the present invention, a method and apparatus for dispensing pills and similar shaped articles has been devised which is broadly comprised of a receptacle for the storage of pills, and first compartment means in communication with the receptacle including a first channel-shaped compartment means operative to isolate one or more pills from the receptacle and to advance the pill into a slot therein; second transfer compartment means including a second compartment or chamber movable into alignment with the slot in said first compartment means to advance said pill or tablet away from the slot in said first compartment means; and third discharge compartment means provided with an exit opening therein so that when the pill is advanced by the second compartment means away from communication with the slot in said first compartment means it is movable into alignment with the exit opening in the third compartment means for discharge of a pill therefrom. The slots in the first and second compartment means are sized in accordance with the size and configuration of pill or tablet to be removed; and each of said first and second compartment means is most desirably provided with a series of different sized slots or openings which may be selectively utilized in combination with one another for the removal of a specified pill or tablet from a receptacle. Further associated with the transfer means are sensing means selectively responsive to advancement of a pill by said second compartment means, the sensing means being responsive to the direction of pill movement in a manner to discriminate pill removal from pill replacement.

Considering certain other more detailed aspects and features of the present invention, most desirably the compartment means are defined by three superimposed disks which are operative, when the receptacle or container is tipped, to advance the pill into a channel or recessed area in the uppermost disk. Once received in the uppermost disk the dispenser may be tipped to advance the pill into a slot substantially conforming to the size and contour of the pill, and which slot is in communication with the second or intermediate disk, the latter functioning as the carrier plate or transfer compartment means. The second disk has a slot which is normally aligned with the slot in the uppermost disk to permit the pill to drop into the second disk. The second disk may be rotated relative to the upper and lowermost disks to rotate the pill into alignment with an exit opening in the lower disk whereupon the pill is free to pass through the exit opening and out of the entire dispenser cap assembly. Preferably the disks are of generally annular configuration with a common centrally located opening extending therethrough, and transparent cover on the upper disk facilitates visual observation of the proper advancement of the pills without jamming from the container to the dispenser cap assembly while maintaining the container fully sealed and assuring that only a single pill is removed at a time.

In one embodiment of the present invention, the removal of a pill from the dispenser cap may be sensed and recorded by the utilization of electrical contacts along the path of movement of the pill between the transfer compartment and discharge or exit opening, and the necessary circuitry for sensing, recording and displaying removal of each pill may be self-contained within the dispenser cap. In another embodiment of the present invention, different sized openings are formed in each of the upper and intermediate disks, the openings in each disk being selectively matched by rotational adjustment to correspond to the size and configuration of pill to be removed. The sensing and recording means is conformable for use with either embodiment of the present invention in sensing the removal of each pill from the dispenser cap and maintaining an accurate record of same.

As employed through the specification, the term "pill" is understood to refer to a pill, tablet or capsule of various sizes and configurations; and as the description proceeds, it will become evident that the slots and openings provided for advancement of each pill may be varied to accommodate pills of different sizes and shapes.

The above and other objects, advantages and features of the present invention will be more readily appreciated and understood from the following description of preferred and alternate embodiments thereof when taken together with the accompanying drawings in which:

DETAILED DESCRIPTION OF THE DRAWINGS

Figure 2:
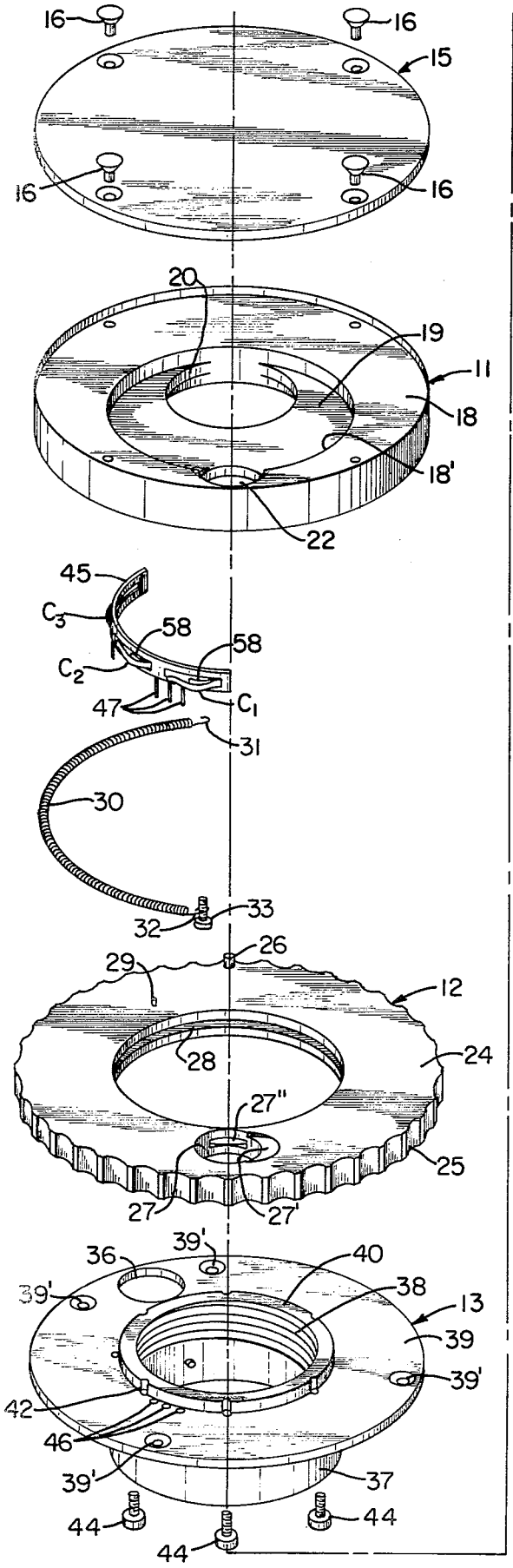
FIG. 2 is an exploded view of the elements comprising the preferred form of dispenser cap mechanism shown in FIG. 1.
Figure 2:
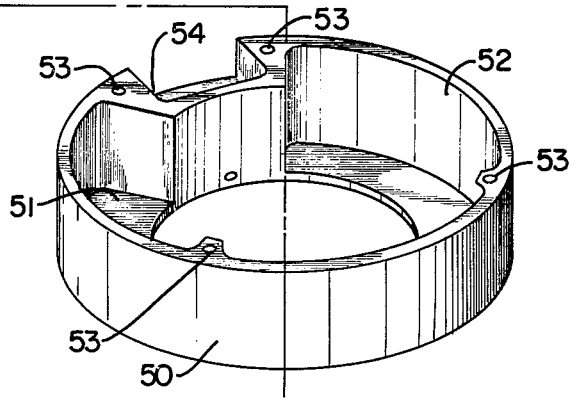
Figure 1:
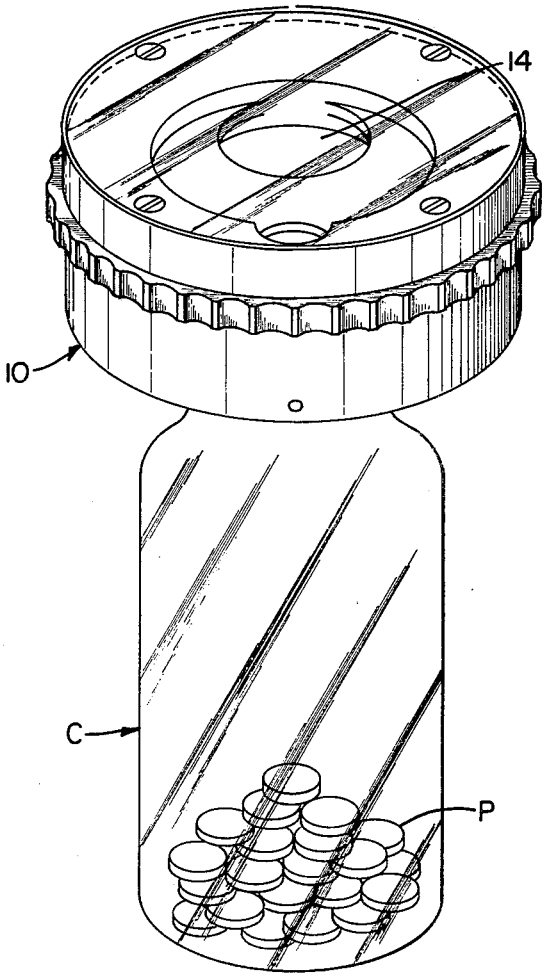
FIG. 1 is a perspective view of a preferred form of dispenser mechanism in accordance with the present invention.
Figure 5:
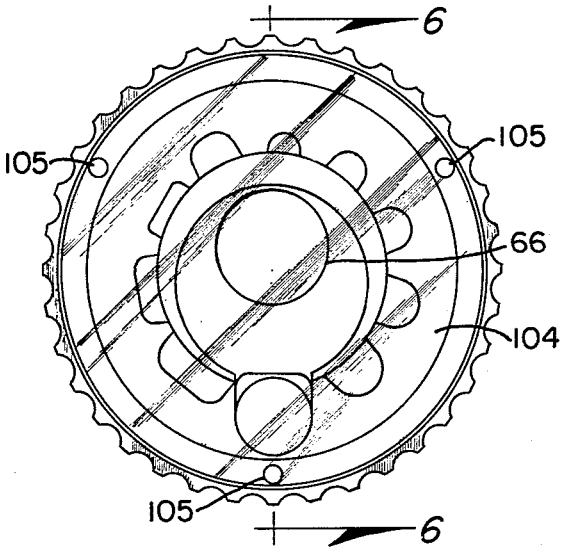
FIG. 5 is a plan view of an alternate preferred form of dispenser mechanism in accordance with the present invention.
Figure 3:
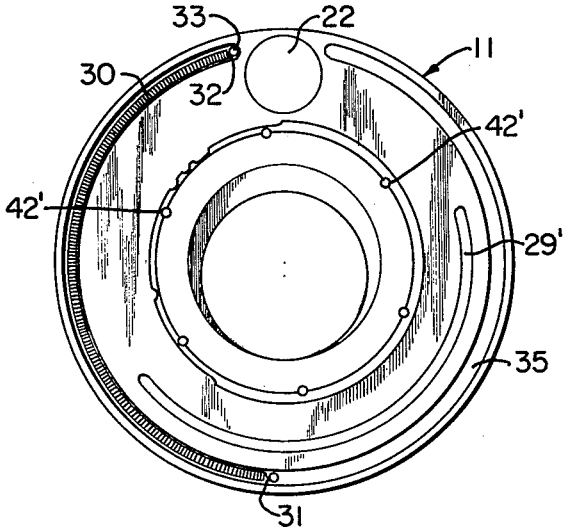
FIG. 3 is a bottom plan view of the upper disk shown in FIG. 2.
Figure 10:
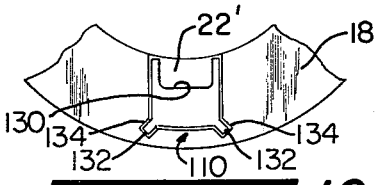
Figure 11:
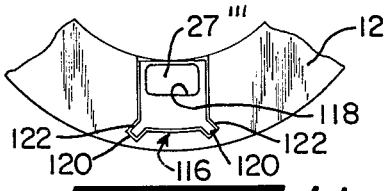

FIG. 10 is a plan view of a modified form of insert and guide slot in the upper disk assembly of FIGS. 1 to 3 to vary the opening size of the slot; and FIG. 11 is a plan view of a modified form of insert and opening for the intermediate disk assembly of FIGS. 1 and 2 to vary the effective size of the opening in accordance with the opening size of the guide slot in the upper disk member shown in FIG. 10.

Referring in more detail to the drawings, there is illustrated in FIGS. 1 to 3 a preferred form of dispensing mechanism which is broadly comprised of a dispenser cap 10 adapted to be threaded or otherwise releasably secured over the mouth of a conventional form of container or receptacle C for pills or tablets generally designated as P. The dispenser cap 10 is made up of a series of superimposed annular disks 11, 12 and 13 which are coaxially arranged and secured together in a manner to be hereinafter described in more detail so as to form a common central opening 14 which is adapted to fit over the mouth of the container C. In addition, the dispenser cap assembly has an upper flat, generally circular transparent cover 15 which is fastened to the uppermost disk 11 by suitable fasteners such as the screws 16. Suitable locking means, not shown, can be utilized to lock the cap onto the bottle so as to prevent removal by children and, in many cases, by the patient.

Considering in more detail the disposition and arrangement of the disks 11, 12 and 13, the upper disk 11 has an outer thickened ring or shelf 18 disposed in surrounding relation to a relatively thin, inner ledge 19, the latter being generally flat and extending radially inwardly from the lower edge of the shelf to terminate in an inner edge 20 which forms the surrounding edge of the central opening 14. A slot 22 extends through the thickness of the shelf 18 with its inner edge in communication with the ledge 19, the slot being sized to conform to the size and configuration of one of the pills P. In this case the pills are of flat circular configuration and the slot is correspondingly circular and is of a diameter just greater than that of the pill.

Middle disk 12 comprises the movable or transfer portion of the disk assembly and, to this end, is made up of a flat annular portion 24 which is slightly greater in diameter than the diameter of the upper disk 11 as well as the lower disk 13. The portion 24 has an external knurled or roughened edge 25. A pin 26 projects upwardly from the upper surface of the annular portion 24 in diametrically opposed relation to a generally circular slot or opening 27, the latter provided with an inclined inner edge 27' as shown to prevent jamming of pills in the opening. An annular groove 28 extends around the inner edge of the annular portion 24 in communication with the inner edge of the opening 27 as illustrated at 27''. In order to control the limits of movement of the intermediate disk 12, a pin 29 projects upwardly from the disk 12 into a circumferential groove 29' in the underside of disk 11. The circumferential length of groove 29' is such as to limit rotation of disk 12 so that at one extreme of the rotational range, the hole 27 in disk 12 is in alignment with slot 22 of disk 11 while at the other extreme of the rotational range, the hole 27 is in alignment with the discharge hole 36 in disk 13. A coiled spring 30 has one end 31 affixed to the pin 26 and the opposite end 32 affixed to a pin 33 which is pressfit into a bore at one end of groove 35 in the undersurface of the shelf portion 18 of the upper disk, as shown in FIG. 3. Here the spring is partially inserted into the open, circumferentially extending groove 35 and serves to return the disk 12 to the position in which the hole 27 is in alignment with the slot 22 of disk 11.

The lower disk 13 is comprised of a central hub 37 provided with an internally threaded portion 38 adapted to threadedly engage the externally threaded mouth of the container C. A flat annular rim 39 is affixed in surrounding relation to the upper end of the hub and is provided with the discharge opening 36 therein. The central hub 37 is provided with an upper edge 40 which projects slightly above the rim 39 and intersects circumferentially spaced holes 42 spaced at closely spaced intervals to receive upwardly projecting screws 44 which are threaded into bores 42' on the underside of the disk 11 so as to interconnect the disks 11 and 13. A switch contact ring or band 45 is disposed in surrounding relation to the upper edge 40, and bores 46 of limited size extend through the thickness of the rim 39 so as to permit downward insertion of a plurality of wires 47 which project downwardly from the band 45. The band 45 is provided further with spring contact arms $C_1$, $C_2$, and $C_3$ which extend radially outwardly from the band at spaced circumferential intervals for a purpose to be hereinafter described. The upper and lower disk assembly 11 and 13 as described is preferably mounted in fixed relation within a shell 50, the shell being generally cup-shaped with a lower annular portion 51 and upwardly projecting wall 52 having circumferentially spaced, threaded openings 53 for the purpose of receiving screw-type fasteners which extend through mating openings 39' in the rim 39 of the disk 13. The alignment between the rim 39 and shell 50 is such that the discharge opening 36 is aligned with a recess 54 in the external wall 52 of the shell so as to form a discharge chute or opening for removal of each pill as it passes downwardly through the opening 36 in the lower disk.

In assembled relation, the intermediate disk 12 is assembled so as to be journaled between the upper and lower disks 11 and 13 with the inner groove 28 on the intermediate disk 12 horizontally aligned with the contact arms $C_1$, $C_2$ and $C_3$ of the band 45. Here the band is stationed on the lower disk as described and is therefore fixed with respect to the movement of the intermediate disk 12. The contact arms $C_1$, $C_2$, and $C_3$ are disposed in circumferentially spaced relation and are biased radially outwardly so that as the opening 27 advances across each of the contact arms, the arm will project through the recessed slot 27'' into the opening 27. However, if a pill is present within the opening 27, it will engage the contact arm to force the arm radially in an inward direction against a stationary contact 58 for each arm which is connected to the wire leads 47. Thus, the contact arms $C_1$, $C_2$ and $C_3$ serve to sense the presence of a pill or tablet within the opening 27, the contact arm $C_1$ being positioned in the path of the opening 27 as it is advanced away from the upper opening 22 of the upper disk 11, the middle contact arm $C_2$ being positioned intermediately between the extreme limits of movement of the opening 27, and the arm $C_3$ being aligned in the path of the opening 27 as it moves into alignment with the lower opening 36.

Figure 4:
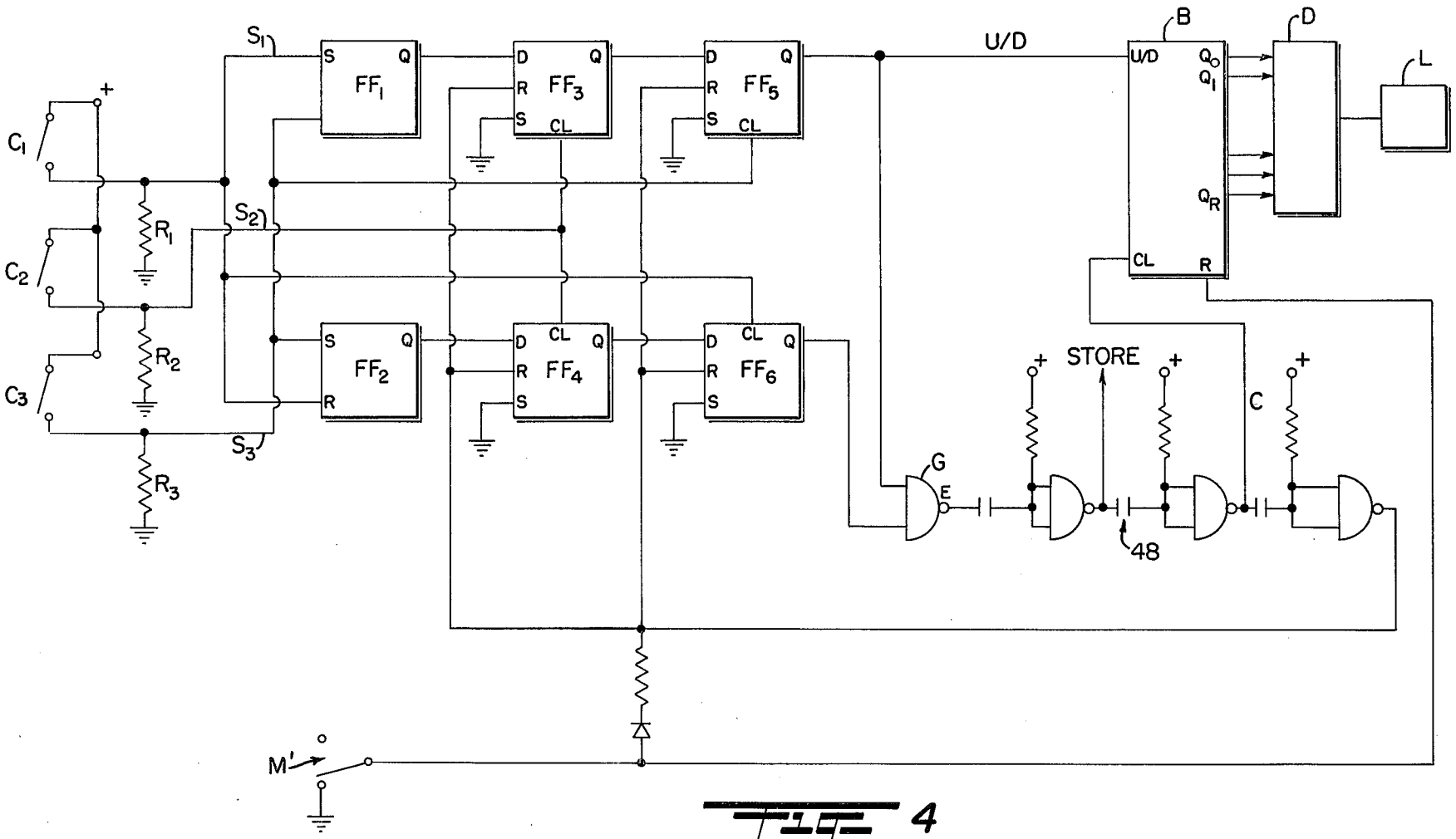
FIG. 4 is a somewhat schematic block diagram of a sensing and recording circuit for use in combination with the dispenser mechanism illustrated in FIGS. 1 and 2.

One form of sensing and recording circuit for use in combination with contact arms $C_1$, $C_2$ and $C_3$ is illustrated in FIG. 4 and is specifically designed to sense removal of a pill from the dispenser without spurious indications of removal irrespective of any reversals in direction of the pill during the course of removal. While a single switch could be employed to sense removal of a pill, such as, by the contact arm $C_3$ aligned with the discharge opening, most desirably a series of three switches are employed so as to assure in each case that actual removal of a pill has been accomplished. As illustrated in FIG. 4, the sensing circuitry shown utilizes the clocked propagation of signals through a sequence of flip-flops $FF_1$ to $FF_6$ to detect pill movement: Closure of the contact arm or switch $C_1$ transmits two data bits into a pair of flip-flops $FF_1$ and $FF_2$. Upon closure of a switch $C_2$, two data bits are clocked into a second pair of flip-flops $FF_3$ and $FF_4$. Finally, upon closure of the third switch $C_3$, one of the data bits is clocked into a third stage flip-flop $FF_5$. Thus, if either or both of the contact arms $C_1$ and $C_2$ are closed prior to closure of the contact arm $C_3$, the logic states of the flip-flops are not changed, and actual removal of a pill is not signaled until the arrival of data at the outputs from the third stage flip-flop $FF_5$. The values of the two data bits which were set at the first switch closure indicate whether the pill movement was a pill removal or replacement. In the circuit, signals $S_1$, $S_2$ and $S_3$ are normally held low by their connection to ground through resistors $R_1$, $R_2$ and $R_3$. When a switch is closed, its corresponding signal is high and, when $C_1$ goes high, a pill removal is anticipated by setting flip-flop $FF_1$ and clearing $FF_2$. When $C_3$ goes high, a pill replacement event is anticipated by clearing $FF_1$ and setting $FF_2$. When $C_2$ goes high, the output of $FF_1$ is clocked into $FF_3$ and the output of $FF_2$ is clocked into $FF_4$. With each closure of $C_1$, the output of $FF_4$ is clocked into $FF_6$; and with each closure of $C_3$, the output of $FF_3$ is clocked into $FF_5$. Clocking of a logic "1" into either $FF_5$ or $FF_6$ signals a pill movement by causing a "1-0" transition of the signal E from NOR gate G into the three-stage monostable multivibrator circuit which, for example, may have a series of three CD4001 integrated circuit chips, the multivibrator circuit generally represented at 48. The output of the first stage monostable multivibrator may be directed to a suitable memory while the output from the second stage is directed to a binary counter, such as, an integrated circuit chip CD4516. The "1-0" transition of the signal E initiates a series of events which deliver timing pulses for storage of information, updating the pill count, and resetting all second and third stage flip-flops. The sequence of three pulses for triggering these three events is obtained from the cascaded series of the three negative edge triggered half monostables 48. Thus the pulse in the first of the monostables is the "store" pulse for data storage, the second pulse is the clock pulse for the binary counter B which counts the pills removed, and the pulse from the third of the series resets the second and third stage flip-flops $FF_3$ to $FF_6$. When the clock pulse arrives, the binary counter increments the pill count if the signal from $FF_5$ is "1" and decrements the pill count if the signal from $FF_5$ is "0". Thus, the outputs from the binary counter indicate the total number of pills removed. The master reset switch designated M' serves to reset the counter to "0" and reset all second and third stage flip-flops $FF_3$ to $FF_6$ to establish the proper initial state for pill passage sensing or detection.

In operation, when a pill passes the first contact arm $C_1$ to close its switch, the output of $FF_1$ is set to a level "1" and the output of $FF_2$ is cleared to a level "0". Any additional spurious closures of $C_1$ merely sets the same values again and has no effect on the state of the logic. When the pill passes arm $C_2$, closure of its switch causes the outputs of $FF_1$ and $FF_2$ to be clocked into $FF_3$ and $FF_4$, as a result of which $FF_3$ will have an output of "1" and $FF_4$ an output of "0". Additional closures of $C_2$ will clock the same values into $FF_3$ and $FF_4$ so as not to change the logic state. When the pill passes arm $C_3$, the logic "1" from $FF_3$ is clocked into $FF_5$ so as to cause a "1-0" transition in the signal E. The value "1" of the output of $FF_5$ indicates that a pill was actually removed; however, if the pill had passed by the switches in the opposite sequence, the output of $FF_5$ would have been "0" at the time of the pill passage indicating that the event was replacement as opposed to removal of a pill. If desired, a suitable display of the pill count from the counter B, along with the event pulses generated by the half-monostable 48 can be incorporated into the dispenser mechanism by directing the output of the binary counter B through additional logic as represented at D, then into any suitable display or recording device such as that represented at L. Although not shown, the sensing and recording circuit as shown in FIG. 4 is preferably contained within the hollow interior of the shell 50 such that the display L is exposed in the external wall of the shell.

In use, the inner portion of disk 11 forms a subcompartment above the bottle into which one or two pills can be placed and can be visualized by virtue of the transparent top or cover 15 which is secured by fasteners 16 over the top surface of the upper disk 11 in the manner shown in FIG. 1. The inner edge 18' of the shelf 18 serves to guide each pill along the inner surface 19 into the slot or opening 22. Once the pill is seated within the opening 22, it will become aligned with the intermediate opening 27 in the disk 12 and pass by gravity into position within the intermediate opening 27. The inclined edge 27' on the trailing edge of the opening 27 of the intermediate disk will prevent jamming of the mechanism in the event that another pill overlies the first pill since it will be forced away from the slot 27 of intermediate disk 12 as it is rotated with respect to the upper disk 11. As the intermediate disk is rotated against the urging of the spring 30, it will advance the pill toward alignment with the opening 36 in the lower disk 13. Further, as previously described, the pill will successively engage the contact switch arms $C_1$, $C_2$ and $C_3$ first engaging $C_1$ as it is rotated away from the upper slot or opening 22 and then engaging $C_2$, and finally $C_3$ before it moves into alignment with the lower opening 36. Sequential closure of the switch arms $C_1$, $C_2$, and $C_3$ assure complete removal of a pill which is counted and stored within the buffer or storage module positioned between the hub portion 37 and shell 50 and which information may be displayed in the same area.

DESCRIPTION OF MODIFIED FORM OF INVENTION

In an alternate preferred embodiment of the present invention, the dispenser mechanism 60 shown in FIGS. 5 to 9 is constructed and arranged for interchangeable use in dispensing different sized pills or tablets. Generally, as can be appreciated from a description of the other preferred embodiment, it is important that the guide slot and transfer openings for the pills closely correspond in cross-sectional size and shape to the article being dispensed. Not only does this avoid jamming by assuring proper alignment of the pill within the opening, but assures contact with the sensing circuitry. To this end, the dispensing mechanism 60 is broadly comprised of an upper disk 61, intermediate disk 62 and a lower disk 63. The upper disk actually comprises a pair of disk elements 64 and 65, the element or section 65 being made up of a relatively thick but flat circular plate provided with a central opening 66 and inner and outer spaced concentric ledges 67 and 68 which form therebetween a channel 69 for insertion of the disk element 64. The innermost ledge 67 is in the form of an arcuate guide which is tapered symmetrically into spaced circumferential edges 70 flanking opposite sides of a flat surface portion 71, the latter extending between the central opening 66 and pill discharge opening 72. As a result, the flat surface portion 71 diverges away from the central opening toward the discharge opening 72 in order to encourage the movement of a pill or tablet away from the central opening and into the discharge opening in a manner similar to that described with respect to FIGS. 1 and 2. In turn, the disk element 64 is in the form of a relatively thin plate and specifically which is of a thickness to occupy the channel-shaped space 69 in the disk element 65, the disk element being held in an aligned position relative to disk 65 by a spring-loaded detent 74 which projects outwardly from the outer peripheral edge of the disk 64 and is adapted to engage one of a series of depressions 75 along the inner peripheral edge of the ledge 68. The disk element 64 is formed with a series of grooves or recesses as designated by the letters a, b, c, d, e, f, g, h, i, and j. Referring for example to the configuration of the groove e, it is of generally oblong configuration and dimensioned to correspond to the size of an elongated capsule or pill P' to be dispensed from container C. Accordingly, when the groove e is aligned over the discharge opening 72, it will encourage proper alignment and disposition of the pill within the groove e before it can be released through the discharge opening. The desired grooves a to j can be aligned with the discharge opening 72 by rotating the disk element 64 until the opening e is properly aligned with the discharge opening 72, at which position the spring-loaded detent engages one of the depressions 75 to retain the disk element 64 in position.

The intermediate, rotatable disk 62 again serves as a transfer compartment for advancement of a pill from the upper disk section 61 into the lower disk section 63. For this purpose, intermediate disk 62 comprises an outer ring element 78 provided with an external roughened or scalloped edge 79 and an inner wall 80 provided with a series of depressions 81 spaced along surface 80. An annular disk element 82 is dimensioned for close-fitting insertion concentrically within the ring 78, the disk element 82 being an annular plate with a series of openings a' through j' essentially corresponding to the grooves a to j of the upper disk element; the only variation is that the openings a' through j' do not intrude into the inner edge of the disk and are formed entirely within the thickness of the disk. In other words, the grooves or slots a to j extend radially away from the inner edge of the disk 64 while the openings a' to j' are spaced in outer concentric relation to inner edge 83 of the disk 82. In addition, the inner edge 83 is provided with a circumferentially extending groove 84 which extends into the slots a' to j' and serves a function corresponding to that of the groove 28 in the form of invention shown in FIGS. 1 and 2; and the slots a' to j' similarly may have inclined planes comparable to the inclined plane 27'.

In the intermediate disk assembly, the inner disk element 82 is provided with a spring-loaded detent 85 adapted to engage one of a series of depressions 81 at the inner edge of the ring 78 so that in a manner corresponding to that described with reference to the disk element 64 and its spring-loaded detent 74, a selected opening e' may be aligned in the same relationship to the entire disk assembly as the slot e. The disk element 82 is supported within the ring 78 by upper and lower cover plates 86 and 87 which are secured to upper and lower edges of the ring by suitable fasteners, not shown, and which fasteners are advanced through limited openings 88 in the outer peripheral edge of the plates into correspondingly spaced openings 89 on the upper and lower surfaces of the inner wall portion 80 of the ring 78. The cover plates 86 and 87 are correspondingly formed with keyways 90 which extend radially from the central opening 91, the plates being so mounted on the ring 78 that the keyways 90 are aligned with the openings a' to j' selected for a particular pill. The plates 86 and 87 are preferably formed of a material which will form moisture shields on opposite sides of the intermediate disk assembly as well as to minimize frictional resistance to rotation of the intermediate disk assembly with respect to the upper and lower disks 61 and 63.

Figure 6:
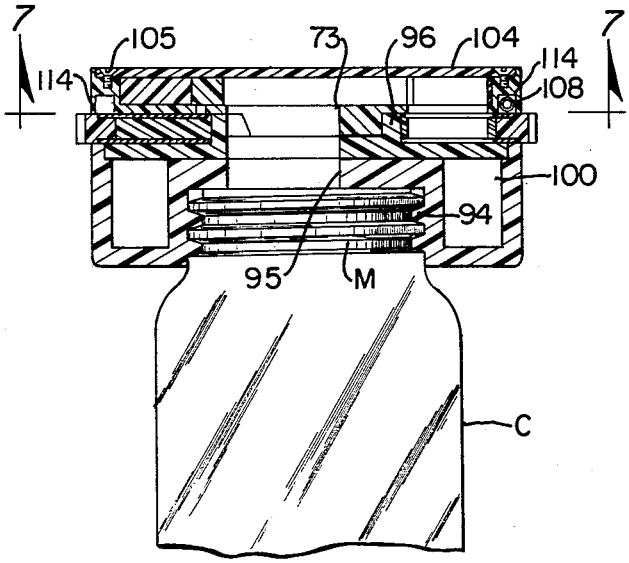
FIG. 6 is a cross-sectional view of the dispenser mechanism shown in FIG. 5 and taken about lines 6—6 of FIG. 5 but shown in assembled relation to a container or receptacle.

The lower disk 63 is of annular configuration having a central opening 94 which, as shown in FIG. 6, is threaded for connection to the mouth M of the container C. As seen from FIGS. 6 and 9, the enlarged opening 94 communicates with a central opening 95 which is of a size corresponding to the opening 66 in the upper disk assembly. The upper surface of the disk 63 is relatively flat, except for an upstanding ledge 96 in surrounding relation to the central opening and a generally U-shaped recess 98 which extends radially outwardly from the ledge through the greater thickness of the disk 63 to serve as a means of discharge for pills passing through the aligned openings in the disk assembly. The disk 63 is also provided with an internal cavity 100 extending throughout the interior of the disk as shown in FIG. 6 to house suitable control or logic circuitry for use in cooperation with the sensing contacts as described with reference to the form of invention shown in FIGS. 1 and 2.

Figure 7:
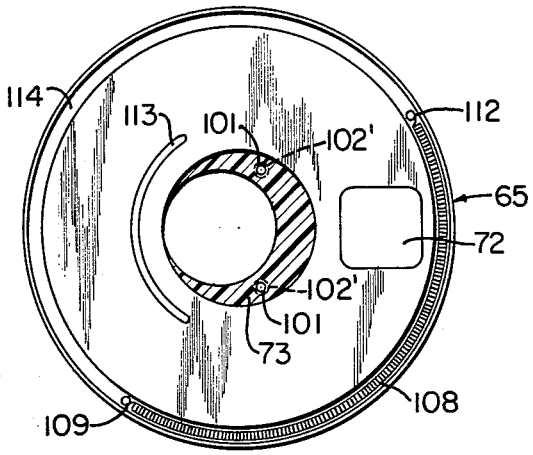
FIG. 7 is a cross-sectional view taken about lines 7—7 of FIG. 6.
Figure 9:
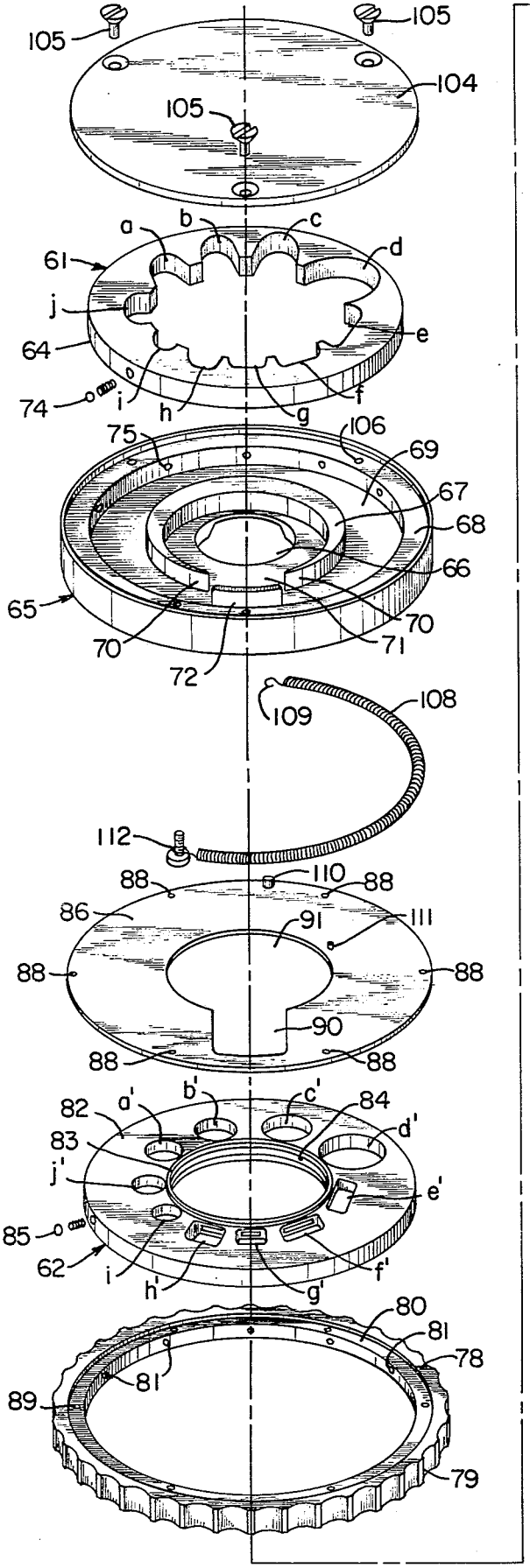
FIG. 9 is an exploded view of the dispenser mechanism of the modified form of invention as shown in FIGS. 5 to 8.
Figure 9:
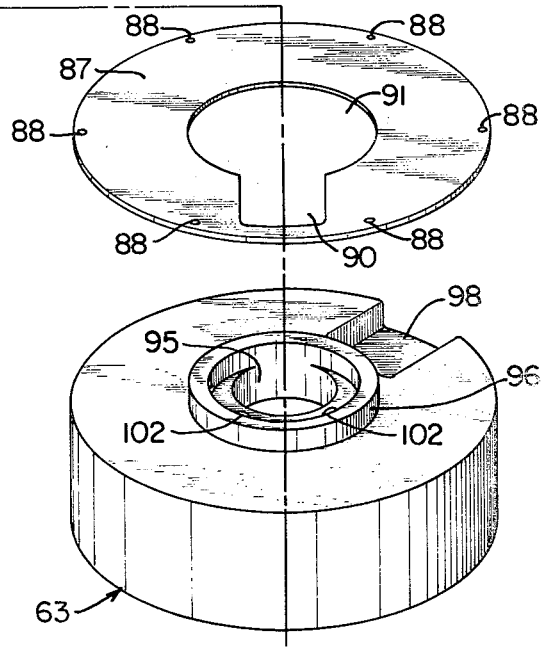
Figure 8:
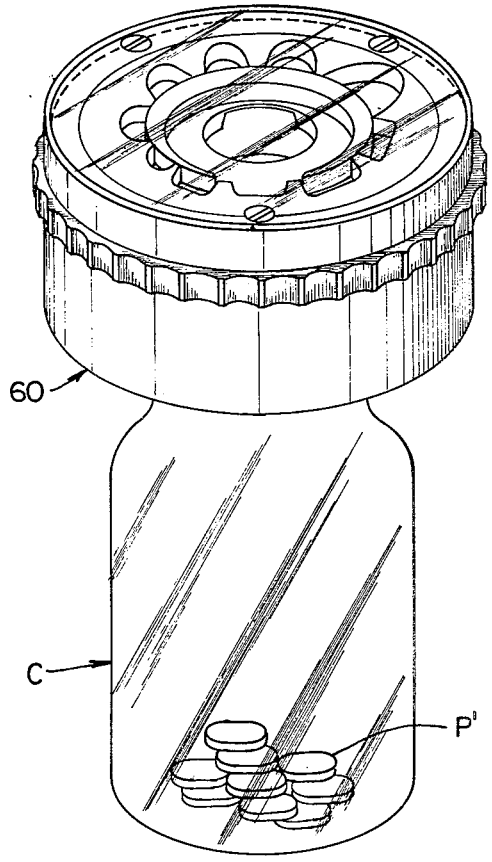
FIG. 8 is a perspective view of the modified form of invention illustrated in FIGS. 5 to 7.

The disks are assembled together with the annular ledge 73 on the upper disk element projecting downwardly within the ledge 96 of the lower disk 63, and are secured by screws 101 which pass through the holes 102 in disk 63 and into threaded bores 102' in disk 65, as shown in FIG. 7, in the same manner as the cooperating holes 42, bores 42' and screws 44 of FIGS. 1 to 3. A transparent cover plate 104 is fastened to the upper disk element 65 by suitable fasteners 105 which are threaded into spaced openings 106 in the upper surface of the outer ledge 68 of the disk so as to complete the assembly and interconnection of elements making up the dispensing cap. The intermediate disk assembly 62 is sandwiched between the upper and lower disk assemblies 61 and 63 but is free to rotate independently of the upper and lower disks in the same manner as described with reference to FIGS. 1 and 2. Again, a coiled spring 108 has one free end 109 affixed to a pin 110 on the upper surface of the plate 86 of the intermediate disk assembly while the opposite end of the spring has a pin 112 insertable into an opening in the undersurface of the disk element 65. The spring 108 is inserted into an annular groove 114 in the undersurface of the upper disk element, and locator pin 111, shown in FIG. 9, is inserted into inner groove 113 as shown in FIG. 7. When assembled, the spring 108 will normally urge the intermediate disk to a position causing the selected discharge opening a' to j' to be aligned with opening 72 in the upper disk and substantially offset from the discharge shelf 98 in the lower disk assembly. However, when the intermediate disk assembly is rotated against the urging of the spring 108, it will advance the discharge opening selected in the intermediate disk assembly into alignment with the opening 98 and, if a pill is present, will permit the pill to drop from the opening a' to j' in the intermediate disk assembly into the discharge shelf 98. When the intermediate disk assembly 62 is released, the spring force will return the disk 62 into its original alignment. Although not illustrated in FIGS. 5 to 9, the sensing circuitry and contact arms as described in FIGS. 2 and 4 may be utilized effectively in association with the alternate embodiment of FIGS. 5 to 9 and mounted in the same identical manner such that the contact arms are aligned with the internal groove 84 of the intermediate disk assembly.

In selecting the slots a to j and openings a' to j', the cover 104 must be removed to permit access to the disk elements 64 and 82 so that their respective disk elements can be rotated until the desired slot or opening, as the case may be, is aligned to correspond with the pill to be dispensed. This may be accomplished, for example, by rotating the upper disk element 64 with the finger; and by rotating the disk element 82 with a slender rod or pick having a lower bent end which is inserted through the opening in the upper disk to engage a sidewall of the aligned opening in the intermediate disk and successively advancing the openings until the proper opening in the intermediate disk is aligned with the upper opening. Thus the pharmacist can make the appropriate adjustment for the desired opening size to correspond with the pill or tablet being dispensed.

FIGS. 10 and 11 illustrate a modification of the preferred form of invention shown in FIGS. 1 to 3 whereby the dispenser cap may be usable for different sized pills by varying the effective opening size of the guide slot 22' and the opening 27''' in the upper disk 11 and intermediate disk 12, respectively. As shown in FIG. 10, an insert 110 has a generally rectangular body with a slotted portion 130 and outwardly projecting, spaced ribs 132 which are adapted for insertion into correspondingly spaced grooves 134 in the surrounding edge of a rectangular-shaped guide slot 22'. The ribs are dimensioned so as to be of a width substantially corresponding to the width of the grooves to enable close-fitting insertion of the insert 110 in place in order to reduce the opening size of the slot to that as illustrated at 130. FIG. 11 illustrates an insert 116 of generally rectangular form sized to correspond to the size of the opening 27''' in the intermediate disk 12 and having an opening 118 reduced to the desired size and configuration. A pair of spaced ribs 120 project outwardly away from the ring for close-fitting insertion in grooves 122 extending from the edge of the opening 27''' and aligned beneath the grooves 134 shown in FIG. 10. The opening 118 is sized to correspond to that of the slot 130 in the insert 110 so as to provide a matched opening for movement of a pill in proper alignment from the slot 130 into the opening 118. Insertion of the inserts 110 and 116 may be readily accomplished by removing the transparent cover 15, turning the disk 12 until the opening 27''' is positioned under the slot 22' in the upper disk 11 and successively placing the insert 116 into the lower opening 27''' and placing insert 110 into the upper guide slot 22'.

It is therefore to be understood that various modifications and changes in the construction and arrangement of parts employed in the preferred form of invention may be made without departing from the spirit and scope of the present invention as defined by the appended claims.

We claim:

1. A pill dispenser adapted for selective removal of pills from a receptacle, comprising:

first compartment means in communication with said receptacle including guide means adapted to receive at least one pill from said receptacle and to isolate said pill in said first compartment means from the other pills in said receptacle;

transfer means including a second compartment provided with a transfer opening in communication with said guide means in said first compartment means, said transfer opening adapted to receive a pill from said guide means when said transfer opening is aligned with said guide means, said transfer means operative to advance said transfer opening away from alignment with said guide means; and discharge means including an exist opening therein, said exit opening being alignable with said transfer opening when said transfer means advances a pill retained in said transfer opening away from said guide means into alignment with said exit opening whereby to permit retrieval of a pill which is advanced by said transfer means into said exit opening, said first and second compartments and said discharge means provided with a common opening therein, and said guide means in communication with said receptacle through said common opening.

2. A pill dispenser according to claim 1, said first and second compartments defined by a plurality of superimposed layers, said transfer means being interposed between said first compartment means and said discharge means.

3. A pill dispenser according to claim 1, said first and second compartments and said discharge means being in the form of superimposed layers provided with a common opening therein, said guide means having a channelshaped guide portion in communication with said receptacle through said common opening, and a transparent cover on said first compartment means.

4. A pill dispenser according to either of claims 1 or 3, said transfer means including a plurality of transfer openings of different sizes, and means for selectively positioning one of said transfer openings for alignment with said guide means so as to receive a pill from said guide means.

5. A pill dispenser according to claim 4 said guide means provided with a plurality of guide slots of different sizes, each slot conforming to the size and configuration of a pill to be dispensed.

6. A pill dispenser according to claim 5, said transfer means including a plurality of transfer openings corresponding in size to that of the guide slots in said first compartment means, and means for rotationally adjusting the alignment of said transfer openings with respect to said first compartment means to selectively align one of said transfer openings with a correspondingly sized guide slot in said first compartment means.

7. A pill dispenser according to claim 1, including sensing means responsive to advancement of said transfer means to sense the presence of a pill in said transfer opening in said second compartment.

8. A pill dispenser according to claim 7, said sensing means including means operative to sense advancement of a pill between said second compartment and said exit opening.

9. A pill dispenser according to claim 7, said sensing means including at least one sensing member aligned with said transfer opening in said second compartment and responsive to engagement with a pill in said transfer opening to transmit a signal, and recording means associated with said sensing means responsive to receipt of a signal from said sensing member to record the presence of a pill in said transfer opening in said second compartment means.

10. A pill dispenser according to claim 9, said sensing means having a pair of sensing members in the path of movement of said transfer opening in said second compartment, each said sensing member responsive to the presence of a pill in said transfer opening to transmit a signal to said recording means.

11. A pill dispenser according to claim 10, one of said sensing members disposed in fixed relation to said second compartment and movable into the path of said transfer opening in said second compartment when said transfer opening approaches the exit opening in said discharge means.

12. A pill dispenser according to claim 10, said sensing means including a series of three circumferentially spaced sensing members disposed in the path of movement of said transfer opening in said second compartment, each said sensing member responsive to the presence of a pill in said transfer opening to transmit a signal to said recording means when a pill has been removed from the dispenser without spurious indications of removal irrespective of any reversals in the direction of the pill during the course of removal.

13. In a pill dispenser wherein a receptacle is provided for the storage of a plurality of pills, and a plurality of compartments are arranged in superimposed relation to one another for the selective removal of pills sequentially from said receptacle, the improvement comprising:

said compartments including a first compartment having a channel-shaped portion in communication with said receptacle whereby to isolate at least one pill received from said receptacle in said channel-shaped portion and said first compartment having a ring of a plurality of guide slots of different sizes selectively communicable with said channel-shaped portion;

a second compartment provided with a ring of a plurality of transfer slots substantially corresponding in size to said plurality of guide slots and selectively alignable with a guide slot, said second compartment and said first compartment being relatively rotatable with respect to one another whereby a pill can be advanced from a guide slot in communication with said channel-shaped portion into a transfer slot when said guide slot and said transfer slot are aligned;

sensing means associated with said compartments operative to sense the presence of a pill in said transfer slot in said second compartment means;

means for positioning any selected one of said guide slots into communication with said channel-shaped portion; and means for aligning any selected one of said transfer slots with a guide slot in communication with said channel-shaped portion.

14. In a pill dispenser according to claim 13, said sensing means defined by a plurality of spaced, electrical contact members operative to transmit a signal in response to the presence of a pill in said transfer slot.

15. A pill dispenser cap having a common opening adapted for engagement with the mouth of a receptacle containing a plurality of pills of predetermined size, said dispenser cap comprising:

a plurality of superimposed disks of annular configuration to define the common opening in said dispenser cap, a first disk defining a first compartment having a transparent cover and channel-shaped portion on its surface adapted to receive a pill from said receptacle and to isolate said pill from the other pills in said receptacle, and guide slot means in said first disk disposed in communication with said channel-shaped portion to receive a pill from said channel-shaped portion;

an intermediate disk interposed between said first disk and a discharge disk and rotatable with respect to said first disk, said intermediate disk being provided with a transfer slot adapted to receive a pill from said guide slot means in said first disk when said transfer slot is aligned therewith; and said discharge disk provided with a discharge opening therein, said discharge opening alignable with said transfer slot when said intermediate disk is rotated to advance a pill retained in said transfer slot into alignment with said discharge opening so as to permit retrieval of a pill through said discharge opening.

16. A pill dispenser cap according to claim 15, including sensing means responsive to advancement of said transfer slot to sense the presence of a pill in said transfer slot in said intermediate disk, said sensing means including means operative to sense advancement of a pill between said first disk and said discharge opening in said discharge disk, and further including an electrical contact member aligned with said transfer slot in said intermediate disk and responsive to engagement with a pill in said intermediate disk to transmit a signal, and recording means associated with said sensing means responsive to receipt of a signal from said electrical contact member to record the presence of a pill in said transfer slot.

17. A pill dispenser cap according to claim 15, further including insert portions in said guide slot means and said transfer slot to vary the effective size of said guide slot means and said transfer slot, respectively, to coincide with the configuration and time of pill to be discharged therethrough.

18. In a pill dispenser adapted for selective removal of pills from a receptacle wherein transfer means are provided to receive a pill from said receptacle and advance said pill into registry with an exit opening for removal of a pill therefrom, the improvement comprising:

sensing means including at least one electrical sensing member responsive to advancement of said transfer means to sense the presence of a pill in said transfer means and to transmit a signal indicating the presence of a pill in said transfer means; and recording means associated with said sensing means responsive to receipt of a signal from said electrical sensing member to record the presence of a pill in said slot in said second compartment means, each said sensing member responsive to the presence of a pill in said transfer means to transmit a signal to said recording means such that said recording means will record when a pill has been removed from the dispenser without spurious indications of removal irrespective of any reversals in the direction of the pill during the course of removal.

19. In a pill dispenser according to claim 18, wherein said electrical sensing member includes at least three electrical sensing members.

20. In a pill dispenser according to claim 19, wherein each said electrical sensing member includes an electrical contact member.

21. A dispenser adapted for selective removal of pills or the like from a receptacle comprising:

a first compartment in communication with the receptacle having means for guiding a pill, said guide means adapted to receive at least one pill from the receptacle and to isolate the pill from the other pills in the receptacle;

a transfer compartment having a transfer opening alignable with said guide means and adapted to receive a pill from said guide means when said transfer opening is aligned with said guide means;

a discharge compartment having an exit opening alignable with said transfer opening and adopted to receive a pill from said transfer opening when said exit opening is aligned with said transfer opening, whereby a pill isolated by said guide means may be received by said transfer opening and thereafter may be received by said exit opening and whereby a pill received by said exit opening may be discharged from the receptacle and the dispenser; and means for sensing the presence of a pill in said transfer opening and for determining whether said pill in said transfer opening is becoming relatively more aligned or less aligned with said exit opening.

22. A receptacle for storing and dispensing pills, the receptacle being oriented normally in an upright position, comprising:

a chamber in which the pills may be contained in a loose and nonordered state;

a ledge capable of supporting a plurality of pills simultaneously, exposed to and in communication with said chamber, said ledge being provided with a slot having a shape substantially conforming to the shape of a pill along at least a portion of the perimeter thereof, whereby moving and orienting the receptacle permits a number of pills less than that needed to fill the ledge to be deposited on and supported by said ledge such that the pills deposited on said ledge are free to move on said ledge and whereby a pill deposited on said ledge may be maneuvered into the slot;

means for selectively removing from the receptacle a pill that has been maneuvered into the slot; and means for electrically sensing the pill as the pill is being removed from the receptacle.

23. A receptacle according to claim 22 further comprising a substantially transparent wall portion positioned such that a person outside the receptacle may view said ledge, said slot, a pill deposited on said ledge, a pill being maneuvered into said slot, the position and orientation of a pill relative to said slot, and a pill in said slot.

24. A receptacle according to claim 22 further comprising means for altering the size of said slot to substantially conform to the size of any pill.

25. A receptacle according to claim 22 wherein said ledge includes a plurality of slots of different sizes and whereby a pill deposited on said ledge may be maneuvered into a selected one of the slots.

26. A receptacle according to claim 22 further comprising at least one slot insert adapted for selective insertion into the slot and for altering the effective size of the slot.

27. A receptacle according to claim 22 wherein the slot is positioned such that a pill drops from one horizontal level to a lower horizontal level as the pill is being removed from the receptacle.

28. A receptacle according to claim 22 wherein the chamber includes a chamber floor upon which the pills normally rest, said chamber floor generally disposed at a first horizontal level when the receptacle is in an upright position, wherein said ledge is generally disposed at a second horizontal level when the receptacle is in an upright position, and wherein the first horizontal level is lower than the second horizontal level.

29. A method of dispensing pills comprising the steps of:

providing a receptacle including (a) a chamber in which the pills may be contained, (b) a ledge capable of supporting a plurality of pills simultaneously, exposed to and in communication with the chamber, the ledge being provided with a slot having a shape substantially conforming to the shape of the pill along at least a portion of the perimeter thereof, and (c) means for electrically sensing the pill as the pill is being removed from the receptacle;

placing at least one pill in the receptacle chamber so that the pill rests upon the chamber floor;

moving and orienting the receptacle so that a number of pills less than that needed to fill said ledge are deposited upon, supported by, and capable of moving freely on the ledge;

moving and orienting the receptacle so that a pill deposited upon and supported by said ledge is maneuvered into the slot;

removing from the receptacle the pill that has been maneuvered into the slot; and electrically sensing the pill as the pill is being removed from the receptacle.

30. A method of dispensing pills according to claim 29 wherein said receptacle further includes a substantially transparent wall portion positioned such that a person outside the receptacle may view said ledge, said slot, a pill deposited on said ledge, a pill being maneuvered into said slot, the position and orientation of a pill relative to said slot, and a pill in said slot and wherein the receptacle is moved and oriented by a person outside the receptacle as the person views the ledge and the slot through the substantially transparent wall portion.

31. A method of dispensing pills according to claim 29 wherein the pill drops from one horizontal level to a lower horizontal level as the pill is being removed from the receptacle.

32. A method of dispensing pills according to claim 29 comprising the further step of changing the size of said slot.

33. A method of dispensing pills according to claim 29 wherein said ledge includes a plurality of different sized slots and includes means for permitting a pill deposited on said ledge to be maneuvered into a selected slot, and wherein the method comprises the further step of selecting the slot into which a pill is maneuvered.

34. A method of dispensing pills according to claim 29 wherein said ledge further includes at least one slot insert adapted for selective insertion into said slot and for altering the effective size of said slot and wherein the method comprises the further step of inserting a slot insert into said slot.

35. A pill dispenser adapted for selective removal of pills or the like from a receptacle, comprising:

means for guiding at least one pill along a selected path from a position within the receptacle to a position outside the receptacle, the pill capable of being guided either forwardly or backwardly along the path;

means for electrically sensing the presence of a pill in said guide means and for electrically sensing whether a pill in said guide means is travelling forwardly or backwardly along the path.

36. A pill dispenser according to claim 35 wherein said sensing means creates a signal in response to the presence of a pill in said guide means and in response to the direction of pill travel along the path, and wherein the dispenser further comprises means for recording a signal created by said sensing means.

37. A pill dispenser according to claim 36 wherein said sensing means includes at least three spaced electrical sensing members adapted to transmit a signal indicating the presence of a pill in said guide means and further comprising means for recording the signal, each electrical sensing member responsive to the presence of a pill in said guide means to transmit a signal to said recording means such that said recording means records when a pill has been removed from the receptacle without spurious indications of removal irrespective of any changes in direction of the pill during the course of removal.

38. A pill dispenser according to claim 37 wherein each said electrical sensing member includes an electrical contact member.

* * * * *